United States Patent [19]

Pinkley et al.

[11] Patent Number: 4,913,655

[45] Date of Patent: Apr. 3, 1990

[54] TRIGGER PULL MEASURING DEVICE FOR AND METHOD OF IMPROVING TRIGGER PULL TECHNIQUE

[76] Inventors: David H. Pinkley, 1209 Sidney; George H. Falterman, 609 W. Park, both of Malden, Mo. 63863

[21] Appl. No.: 254,215

[22] Filed: Oct. 6, 1988

[51] Int. Cl.[4] ..... F41F 27/00

[52] U.S. Cl. ..... 434/16; 42/1.01

[58] Field of Search ..... 434/16, 18, 19; 42/1.01, 1.02, 1.03, 1.04

[56] References Cited

U.S. PATENT DOCUMENTS

| | | | |
|---|---|---|---|
| 1,786,614 | 12/1930 | Howard | 42/1.01 |
| 2,325,599 | 8/1943 | Fidelman | 42/1.01 |
| 3,888,021 | 6/1975 | McCurdy | 434/19 |
| 4,541,191 | 9/1985 | Morris et al. | 42/1.01 |

*Primary Examiner*—William H. Grieb

*Attorney, Agent, or Firm*—Senniger, Powers, Leavitt and Roedel

[57] ABSTRACT

A trigger pull measuring device adapted for connection to the trigger mechanism of a weapon for measuring the trigger pull of the weapon in order to improve trigger pull technique, comprising a variable resistor having a sliding contact for varying the resistance of the resistor, connected to a voltage source, and a linkage for connecting the sliding contact of the variable resistor to the trigger mechanism of the weapon so that movement of the trigger moves the sliding contact of the resistor. The device further comprises a battery for applying a voltage across the variable resistor and a chart recorder for measuring and displaying the resistance across the variable portion of the variable resistor to measure the position of the trigger.

The method of the present invention comprises a method of improving trigger pull technique for firing a weapon with a trigger, the method comprising the steps of continuously measuring trigger displacement as the trigger is pulled and displaying the trigger displacement to the person firing the weapon, to enable the person to correct defects in trigger pull technique.

26 Claims, 2 Drawing Sheets

TRIGGER PULL MEASURING DEVICE FOR AND METHOD OF IMPROVING TRIGGER PULL TECHNIQUE

BACKGROUND OF THE INVENTION

This invention relates to weapons training, and in particular to a trigger pull measuring device for, and method of, improving trigger pull technique.

Proper trigger pulling technique is essential for safe and accurate firing of a weapon. Proper trigger pulling technique requires the application of steady pressure to smoothly and steadily move the trigger until the weapon fires. Unsteady trigger motion or jerking of the trigger can ruin the shooter's aim. It is difficult to teach someone how to properly move the trigger smoothly and steadily. Small jerks or breaks in the movement of the trigger are often unperceptible to an observer and even to the shooter.

SUMMARY OF THE INVENTION

It is among the objects of the present invention to provide a device for improving trigger pull technique that displays the trigger movement for the user, and in particular to provide such a device that measures the position of the trigger and continuously displays the position as a function of time. It is also among the objects of this invention to provide such a device that provides a display of the trigger movement to enable diagnosis of defects in the shooter's trigger pulling technique and to provide feedback for the shooter to correct those defects. It is further among the objects of the present invention to provide a method of instructing shooters of the proper trigger pulling technique, and in particular to provide the students with a visual representation of the trigger position as they operate the trigger to improve the shooter's control over trigger movement.

In general the device of the present invention is adapted for connection to the trigger mechanism of a weapon for continuously measuring the rate of motion of the trigger in order to improve trigger pull technique. The device comprises means connected to the trigger mechanism for measuring the position of the trigger and means for displaying the position of the trigger as a function of time.

The means for measuring the position of the trigger preferably comprises a variable resistor having a sliding contact, means for connecting the sliding contact of the variable resistor to the trigger mechanism so that movement of the trigger moves the sliding contact of the resistor, and means for measuring the resistance of the variable resistor (which corresponds to trigger position). The measuring means may comprise means for applying a voltage across the variable resistor and means for measuring the voltage across the variable portion of the resister to measure the position of the trigger.

The means for displaying the trigger position as a function of time preferably comprises a chart recorder for continuously recording the measured voltage across the variable portion of the resistor.

Generally, the method of improving trigger pull technique according to the present invention comprises the steps of continuously measuring trigger position as the trigger is pulled and displaying the measured trigger displacement as a function of time to the person firing the weapon.

The trigger pull measuring device displays the trigger position as a function of time (i.e. rate of trigger motion) to enable the shooter to diagnose problems in trigger pull technique and thereby eliminate unsteadiness or unevenness in the movement of the trigger. Similarly the method of the present invention provides the shooter with a visual representation of the trigger position and rate of movement as the trigger is operated, allowing the shooter to adjust the trigger pulling motion to achieve a smooth and steady trigger movement and to improve the shooter's control over trigger movement.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
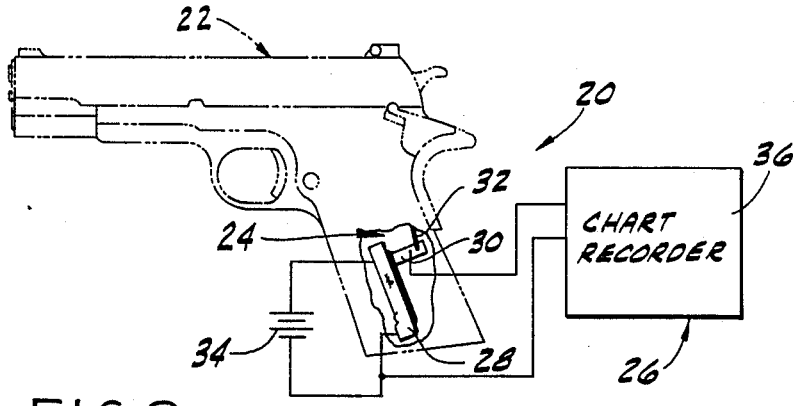
FIG. 1 is a schematic view of a trigger pull measuring device constructed according to the principles of the present invention and adapted for use in the method of the present invention.

A trigger pull measuring device constructed according to the principles of the present invention, indicated generally as 20, is shown schematically in FIG. 1. The device 20 is adapted for connection to the trigger mechanism of a weapon (e.g. pistol 22, shown in phantom) for measuring the rate of trigger pull of the weapon in order to improve trigger pull technique. Although the device is described and illustrated herein in conjunction with pistols, the invention is not so limited and it may be applied to any weapon which is actuated by a trigger. The device comprises means 24 connected to the trigger mechanism for measuring the position of the trigger, and means 26 for displaying the position of the trigger as a function of time. In the preferred embodiment, the means 24 for measuring the position of the trigger comprises a variable resistor 28 having a sliding contact 30, and means 32 for connecting the sliding contact 30 of the variable resistor 28 to the trigger mechanism so that movement of the trigger moves the sliding contact 30 of the resistor 28.

The measuring means further comprises means for measuring the resistance of the variable resistor. This preferably includes means for applying a voltage across the variable resistor 28, such as battery 34, and a means for measuring the voltage across the variable portion of the resistor 28. The voltage measuring means is preferably part of a chart recorder 36. The chart recorder 36 also constitutes means for displaying the position of the trigger as a function of time. The chart recorder 36 provides a printed graph of trigger position versus time so that any unevenness in trigger motion is readily apparent. For example, fast pulls or jerks on the trigger will show up as vertical lines on the graph and gaps or stops in trigger movement will show up as horizontal lines on the graph.

Figure 2:
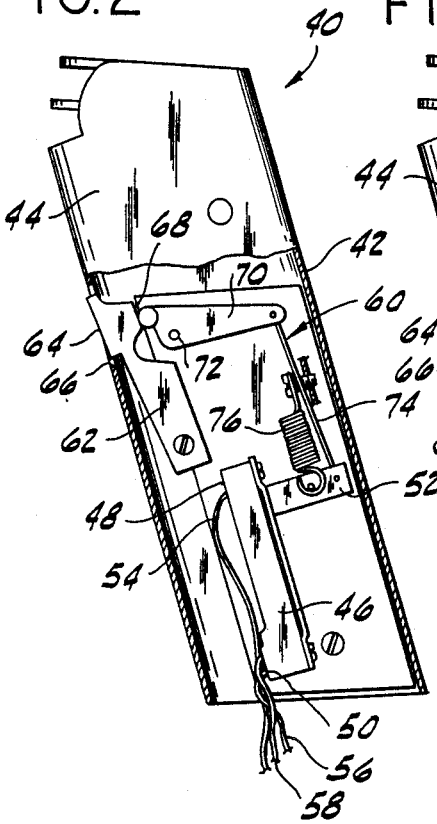
FIG. 2 is a side elevation of a first embodiment of a trigger pull measuring device according to the present invention, adapted for use in a weapon of the type employing clips of ammunition.
Figure 3:
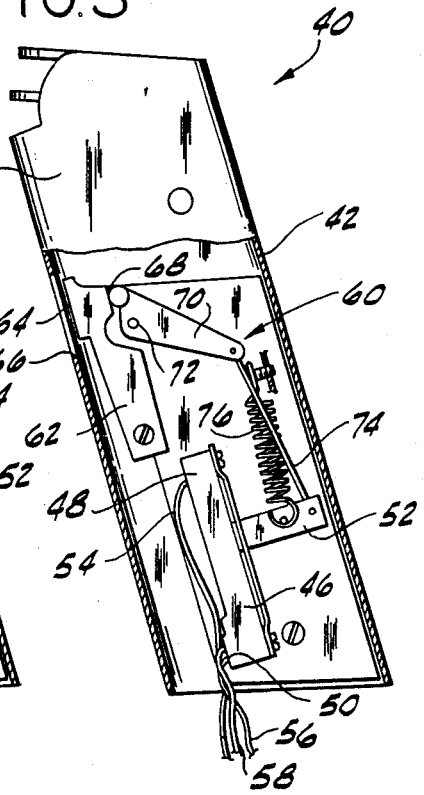
FIG. 3 is a side elevation of the trigger pull measuring device shown in FIG. 2, shown as it would appear with the trigger depressed.

A first embodiment of the a trigger pull measuring device constructed according to the principles of this invention is indicated generally as 40 in FIGS. 2 and 3. The device 40 is particularly adapted for use with a weapon of the type employing a magazine or clip for the ammunition. The device 40 comprises a housing 42, which is preferably the same size and shape as the standard clip or magazine for the weapon. The top portion of housing may be provided with a space 44 to receive one or more rounds, so that the weapon can still be fired. The trigger pull measuring mechanism is disposed in the lower portion of the housing 42.

The mechanism comprises a variable resistor 46 of the type having a terminal at each end, 48 and 50, respectively, and a sliding contact 52 for varying the resistance of the resistor 46. Means, such as wire leads 54 and 56, connected to terminals 48 and 50, respectively, are provided for applying a voltage across the variable resistor 46. For example, wire leads 54 and 56 might be connected to the positive and negative terminals of a battery (not shown). A third wire lead 58 may be electrically connected to the sliding contact 52. Means such as linkage 60 is provided for connecting the sliding contact 52 of the variable resistor 46 to the trigger mechanism of the weapon so that movement of the trigger moves the sliding contact 52 of the resistor 46.

The linkage 60 preferably comprises a lever arm 62 pivotally mounted at one end to the housing 42, and having a first face 64 aligned with an opening 66 in the housing 42 so positioned that when the device 40 is inserted in a weapon, the first face 64 engages a portion of the trigger mechanism that moves in proportion to the movement of the trigger. Thus movement of the trigger will cause the lever arm 62 to pivot (generally clockwise as viewed in FIGS. 2 and 3). The lever arm 62 further comprises a second face 68 adapted to engage and turn rocker 70, which is pivotally mounted to the housing 42 with a pin 72. A link 74 extends between the rocker 70 and the sliding contact 52 of the resistor 46. Thus, when the trigger mechanism pivots lever am 62, lever arm 62 engages and turns rocker 70, which causes link 74 to push the sliding contact 52 of resistor 46. The sliding contact 52 moves from its rest position shown in FIG. 2 (in which the trigger is in its normal position) to a position such as shown in FIG. 3 (in which the trigger has been moved).

The device further comprises means for measuring the resistance of the variable resistor 46, for example by measuring the voltage across the variable portion of resistor 46. The voltage may be measured by the measuring the voltage between wire lead 58 and either of the other wire leads, but preferably lead 56, which is connected as a common ground. The actual voltage measurement may be made by a chart recorder (not shown) which continuously displays the measured voltage as a function of time. This voltage is representative of the resistance across variable resistor 46, which in turn is representative of trigger position. The slope of the plot of trigger position versus time shows the rate of trigger movement. A suitable chart recorder for this purpose is the Model Brush 250 chart recorder manufactured by Gould.

The device further comprises means, such as spring 76, for biasing the sliding contact 52 to its rest position corresponding to zero displacement of the trigger (FIG. 2), to restore the sliding contact 52 after the trigger is released. Spring 76 is preferably a coil spring one end of which is secured to the sliding contact 52, and the other end of which is anchored to the housing 42. For example, the end of the spring 76 may be secured to a tab 78 with a screw 80.

Figure 4:
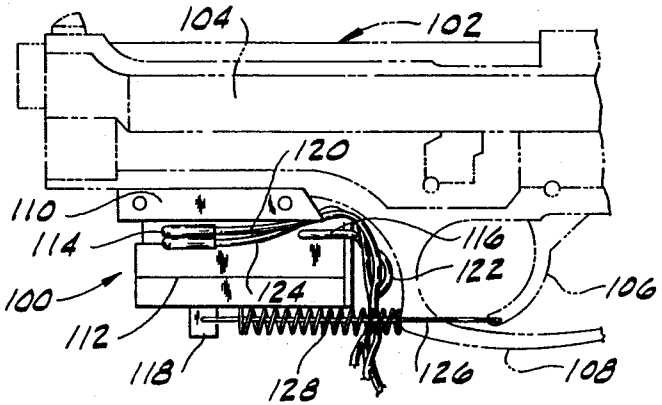
FIG. 4 is a side elevation of a second embodiment of a trigger pull measuring device constructed according to the principles of this invention; and, FIG. 5 is a sample output graph from one of the trigger pull measuring devices of the present invention.

A second embodiment of the a trigger pull measuring device constructed according to the principles of this invention is indicated generally as 100 in FIG. 4. The device 100 is shown as it would be mounted on a conventional pistol 102 (shown in phantom) comprising barrel 104, trigger 106, and trigger guard 108. The device 100 comprises a mounting block 110 for mounting the device to the barrel 104 of the pistol 102, in front of the trigger guard 108. The device comprises a variable resistor 112 of the type having a terminal at each end, 114 and 116, respectively, and a sliding contact 118 for varying the resistance of the resistor. Means, such as wire leads 120 and 122 connected to terminals 114 and 116, respectively, are provided for applying a voltage across the variable resistor 112. For example, wire leads 120 and 122 might be connected to the positive and negative terminals of a battery. A third wire lead 124 may be electrically connected to the sliding contact 118. A link 126 is provided for connecting the sliding contact 118 of the variable resistor 112 to the trigger 106 of the pistol 102, so that movement of the trigger 106 moves the sliding contact 118 of the resistor 112. The link 126 extends through an opening formed in the the trigger guard 108 for that purpose.

The device further comprises means for measuring the resistance of the variable resistor 112, for example by measuring the voltage across the variable portion of resistor 112. The voltage may be measured by the measuring the voltage between wire lead 124 and either of the other wire leads 120 or 122, but preferably lead 122 which is connected to a common ground. The actual voltage measurement may be made by a chart recorder (not shown) which continuously displays the measured voltage as a function of time. As noted above, a suitable chart recorder is a Model Brush 250 chart recorder manufactured by Gould.

The device 100 further comprises means, such as spring 128, for biasing the sliding contact 118 to its position corresponding to zero displacement of the trigger 100 (i.e., to the left as viewed in FIG. 4), to restore the sliding contact 118 after the trigger 100 is released. Spring 128 is preferably a coil spring disposed over the link 124. One end of the spring 128 engages the exterior of the trigger guard 108 and the other end engages a stop on the link 124, so that the spring 128 is compressed as link 124 moves (t the right in FIG. 4) as the trigger moves.

Figure 5:
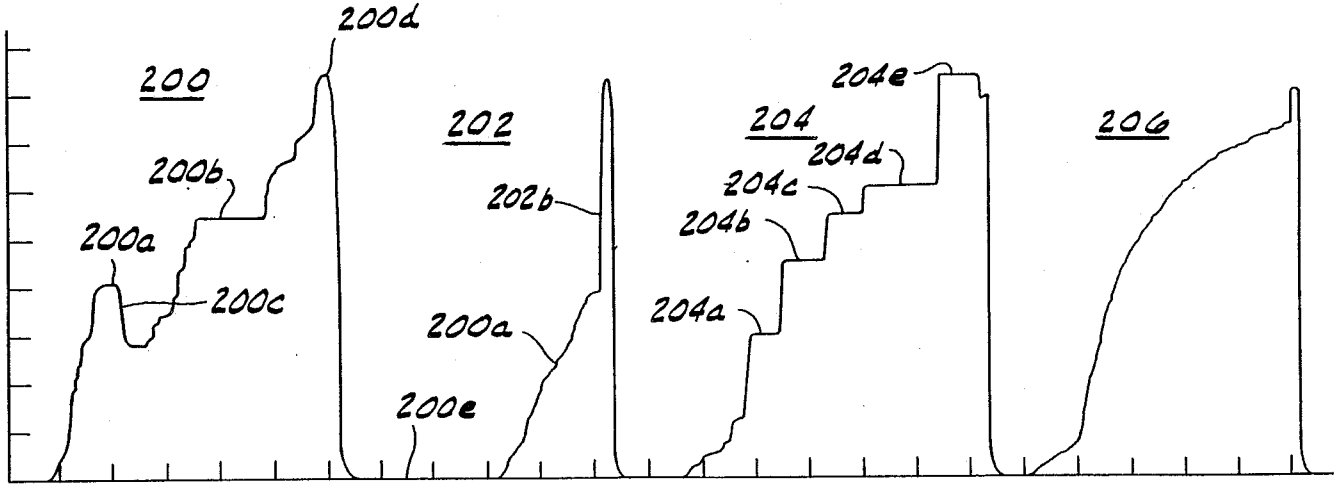

The graph of the trigger position versus time, and the rate of trigger movement (the slope of this line) provides valuable information about the shooter's trigger pull motion. The information is not otherwise readily observable, even by an experienced instructor. FIG. 5 illustrates the graphs of four different trigger pulls 200, 202, 204 and 206.

In graph 200 the plateaus **200*a* and 200*b* indicate points where the shooter stopped motion of the trigger. The downwardly sloped portion 200*c* indicates a point where the shooter actually allowed the trigger to relax or move backward. The sharp peak 200***d* indicates a timely release of the trigger after the shot, but the flat line 200*e* indicates to much delay between successive shots.

In graph 202 the upwardly sloped portion 202*a* indicates generally smooth and continuous trigger motion, but the substantially vertical portion 202*b* indicates a jerking motion immediately before firing.

In graph 204 the plateaus 204*a*, 204*b*, 204*c*, and 204*d* indicate points where trigger motion halted. The flat peak 204*e* indicates that the trigger was held too long after the shot was fired.

Finally, graph 206 shows a smooth and continuous trigger motion from the start to the firing.

The method of improving trigger pull technique of the present invention a trigger, comprises the steps of continuously measuring trigger displacement as the trigger is pulled and displaying the trigger displacement to the person firing the weapon, preferably as a graph of displacement versus time. The display of trigger displacement provides valuable diagnostic information about defects in the shooter's trigger pull technique. Furthermore the continuous display of the displacement as the shooter is pulling the trigger provides feedback for improving control of trigger pulling.

OPERATION

The device of the present operation is installed on the gun, and the gun is held and fired as a normal gun. For example, in the embodiment shown in FIGS. 2 and 3 the device 40 is inserted into the weapon and the lead wires 54 and 56 connected to the positive and negative terminals of a battery and the lead wires 58 and 56 connected to a chart recorder. As the trigger of the weapon is pulled, the trigger mechanism of the weapon presses on the first face 64 of the lever arm 62, exposed in opening 66, causing the lever arm 62 to turn (generally clockwise as shown in FIG. 2). The motion of the lever arm 62 causes the rocker 70 to pivot (also generally clockwise as shown in FIG. 2). The pivoting of rocker 70 causes link 74 to move (generally downwardly as shown in FIG. 2) pushing the sliding contact 52 to the position in FIG. 3. The motion of the sliding contact 52 causes a change in the resistance of variable resistor 46. This change in resistance is measured to measure trigger position, and displayed by the chart recorder. Of course some other method of measuring the variable resistance could be used, for example measuring the current through the variable resistor. After the trigger is released, the spring 76 restores the sliding contact 52 to its original position (FIG. 2).

In the embodiment shown in FIG. 4, the device 100 is installed on a weapon, with link 126 connected to trigger 106. The wire leads 120 and 122 are connected to the positive and negative terminals of a battery, and leads 124 and 122 are connected to a chart recorder. Movement of the trigger 106 causes link 126 and thus sliding contact 118 of resistor 112 to move. The motion of the sliding contact 118 causes a change in the resistance of variable resistor 112. As with device 40, this changing resistance value can be measured to measure trigger position, and displayed on the chart recorder. After the trigger is released, the spring 128 restores the sliding contact to its original position.

According to the method of this invention, as the shooter pulls the trigger, the trigger displacement is displayed to the shooter, preferably as a graph versus time. Thus, the shooter can try to control trigger movement to produce a smooth and continuous sloped graph of trigger position versus time. Vertical lines indicate pulling the trigger too fast and horizontal lines indicate pulling the trigger to slowly, and downwardly sloped lines indicate releasing the trigger during the trigger stroke.

With this information instructors can instruct the shooter on appropriate corrective measures and the shooter can experiment with different techniques to achieve the desirable smoothly sloped trigger displacement versus time chart.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A trigger pull measuring device adapted for connection to the trigger mechanism of a weapon for measuring the trigger pull of the weapon in order to improve trigger pull technique, the device comprising:

means connected to the trigger mechanism for measuring the instantaneous position of the trigger;

and means for displaying the position of the trigger as a function of time.

2. The trigger pull measuring according to claim 1 wherein the measuring means comprises means for generating an electrical signal proportional to the position of the trigger and means for measuring the electrical signal.

3. A trigger pull measuring device adapted for connection to the trigger mechanism of a weapon for measuring the trigger pull of the weapon in order to improve trigger pull technique, the device comprising:

means connected to the trigger mechanism for measuring the position of the trigger, said means comprising a variable resistor having a sliding contact, and means for connecting the sliding contact of the variable resistor to the trigger mechanism so that movement of the trigger moves the sliding contact of the resistor;

and means for displaying the position of the trigger as a function of time.

4. The trigger pull measuring device according to claim 3 further comprising means for measuring the resistance of the variable resistor.

5. A trigger pull measuring device adapted for connection to the trigger mechanism of a weapon for measuring the trigger pull of the weapon in order to improve trigger pull technique, the device comprising:

a variable resistor having a sliding contact for varying the resistance of the resistor;

means for applying a voltage across the variable resistor;

means for connecting the sliding contact of the variable resistor to the trigger mechanism of the weapon so that movement of the trigger moves the sliding contact of the resistor;

means for measuring the voltage across the variable portion of the variable resistor to measure the position of the trigger.

6. The trigger pull measuring device according to claim 5 further comprising means for displaying a measure of trigger position as a function of time.

7. The trigger pull measuring device according to claim 6 wherein the display means comprises a chart recorder for displaying the measured voltage as a function of time.

8. The trigger pull measuring device according to claim 5 further comprising means for biasing the sliding contact to its position corresponding to no displacement of the trigger, to restore the sliding contact after the trigger is released.

9. The trigger pull measuring device according to claim 5 wherein the means for applying a voltage across the resistor comprises a battery.

10. The trigger pull measuring device according to claim 5, wherein the device is adapted for use in a weapon of the type having a socket for receiving a clip or magazine, the device comprising a support adapted to be received in the socket, wherein the resistor is mounted on the support, and wherein the means for connecting the sliding contact of the resistor to the trigger mechanism comprises a linkage.

11. The trigger pull measuring device according to claim 10 wherein the linkage comprises a first lever arm pivotally mounted at one end and having a first face adapted for engagement with a portion of the trigger mechanism that moves in Proportion to the movement of the trigger, a rocker member adapted to be pivoted by the lever member, and a link extending between the rocker member and the sliding contact of the resistor to move the sliding member as the rocker member pivots.

12. The trigger pull measuring device according to claim 11 further comprising means for biasing the sliding contact to its position corresponding to no displacement of the trigger, to restore the sliding contact after the trigger is released.

13. The trigger pull measuring device according to claim 11 wherein the biasing means comprises a spring one end of which is connected to the sliding contact and the other end of which is anchored to the clip housing.

14. The trigger pull measuring device according to claim 5 wherein the variable resistor is mounted on the exterior of the weapon, and wherein the means for connecting the sliding contact to the trigger mechanism comprises a link extending between the trigger and the sliding contact.

15. The trigger pull measuring device according to claim 14 further comprising means for biasing the sliding contact to its position corresponding to no displacement of the trigger, to restore the sliding contact after the trigger is released.

16. The trigger pull measuring device according to claim 15 wherein the biasing means comprises a coil spring disposed on the link with one end anchored to the link and the other end is anchored to the weapon such that movement of the trigger compresses the coil spring.

17. A trigger pull measuring device adapted for use with a weapon of the type having a socket for receiving a clip or magazine of ammunition, the device adapted for connection to the trigger mechanism of the weapon for measuring the trigger pull of the weapon in order to improve trigger pull technique, the device comprising:

a support configured to be received in the socket of the weapon;

a variable resistor having a sliding contact for varying the resistance of the resistor, mounted on the support;

means for applying a voltage across the variable resistor;

a linkage for connecting the sliding contact of the variable resistor to the trigger mechanism of the weapon when the support is received in the socket so that movement of the trigger moves the sliding contact of the resistor;

means for measuring the voltage across the variable portion of the variable resistor to measure the position of the trigger.

18. The trigger pull measuring device according to claim 17 wherein the linkage comprises a first lever arm pivotally mounted at one end and having a first face adapted for engagement with a portion of the trigger mechanism that moves in proportion to the movement of the trigger, a rocker member adapted to be pivoted by the lever member, and a link extending between the rocker member and the sliding contact of the resistor to move the sliding member as the rocker member pivots.

19. The trigger pull measuring device according to claim 17 further comprising means for biasing the sliding contact to its position corresponding to no displacement of the trigger, to restore the sliding contact after the trigger is released.

20. The trigger pull measuring device according to claim 19 wherein the biasing means comprises a spring one end of which is connected to the sliding contact and the other end of which is anchored to the clip housing.

21. A trigger pull measuring device adapted for connection to the trigger mechanism of a weapon for measuring the trigger pull of the weapon in order to improve trigger pull technique, the device comprising:

a variable resistor having a sliding contact for varying the resistance of the resistor, mounted on the weapon;

means for applying a voltage across the variable resistor;

a link for connecting the sliding contact of the variable resistor to the trigger of the weapon so that movement of the trigger moves the sliding contact of the resistor;

means for measuring the voltage across the variable portion of the variable resistor to measure the position of the trigger.

22. The trigger pull measuring device according to claim 21 further comprising means for biasing the sliding contact to its position corresponding to no displacement of the trigger, to restore the sliding contact after the trigger is released, said biasing means comprising a coil spring disposed on the link with one end anchored to the link and the other end is anchored to the weapon such that movement of the trigger compresses the coil spring.

23. A method of improving trigger pull technique for firing a weapon with a trigger, the method comprising the steps of:

continuously measuring the instantaneous position of the trigger as the trigger is pulled;

displaying the instantaneous position of the trigger to the person firing the weapon.

24. The method according to claim 23 wherein the step of displaying the trigger displacement comprises displaying a graph of trigger displacement versus elapsed time.

25. A method of improving trigger pull technique for firing a weapon with a trigger, the method comprising the steps of:

connecting the trigger mechanism to the sliding contact of a variable resistor so that movement of the trigger moves the sliding contact of the resistor;

continuously measuring the resistance of the variable resistor to measure displacement of the trigger; and displaying the trigger displacement to the person firing the weapon.

26. The method according to claim 25 wherein the step of measuring the resistance of the variable resistor comprises the steps of:

applying a voltage across the resistor;

measuring the voltage across the variable part of the resistor.

* * * * *